US005974282A

United States Patent [19]

Yamada

[11] Patent Number: 5,974,282

[45] **Date of Patent: *Oct. 26, 1999**

[54] IMAGE FORMING APPARATUS

[75] Inventor: Takanobu Yamada, Toyokawa, Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/228,985

[22] Filed: Jan. 12, 1999

[30] Foreign Application Priority Data

Jan. 13, 1998 [JP] Japan ..... 10-004424

[51] Int. Cl.[6] ..... G03G 15/16; G03G 15/20

[52] U.S. Cl. ..... 399/66; 399/302; 399/303

[58] Field of Search ..... 399/45, 66, 297, 399/298, 299, 301, 302, 303, 308, 372, 361, 381

[56] References Cited

U.S. PATENT DOCUMENTS 4,662,739 5/1987 Sakai et al. ..... 399/66

5,506,660 4/1996 Rabb et al. ..... 399/66

FOREIGN PATENT DOCUMENTS 05002347 8/1993 Japan .

*Primary Examiner*—Arthur T. Grimley
*Assistant Examiner*—Hoang Ngo
*Attorney, Agent, or Firm*—McDermott, Will & Emery

[57] ABSTRACT

The present invention is directed an image forming apparatus as a Tandem type color copying machine in which a paper 11 is fed to a predetermined portion where an image is transferred to the paper. In a case where an image which is adversely affected by a seam 10*a* of a transporting belt 10, such as a color image or a photo image, is transferred to the paper 11, the paper 11 is fed to the transporting belt 10 so as not to overlap the seam 10*a*. In a case where an image which is not affected by the seam, such as a white-and-black image or a text image, is transferred to the paper 11, the paper 11 is fed to the transporting belt 10 regardless of the position of the seam 10*a*.

13 Claims, 11 Drawing Sheets

IMAGE FORMING APPARATUS

BACKGROUND OF THE INVENTION

1. Field of the Invention

The present invention relates to an image forming apparatus which is utilized as a copying machine, a laser printer, a facsimile machine, or a similar apparatus, and more particularly, to an image forming apparatus preferably utilized as a Tandem-type color copying machine.

2. Description of the Related Art

FIG. 13 shows a schematic cross-sectional side view of a printer unit of a Tandem-type color copying machine. As shown in FIG. 13, the copying machine is provided with an endless transferring belt 10 and photosensitive drums 2Y, 2M, 2C, 2K. The photosensitive drums 2Y, 2M, 2C, 2K are disposed along the traveling path of the transferring belt 10 and correspond to the colors, yellow (Y), magenta (M), cyan (C), and black (K), respectively. A paper-feed unit 5 and resist rollers 6 are disposed at the upstream portion of the transferring belt 10. Further, fixing rollers 7 are provided at the down-stream portion of the transferring belt 10.

In this copying machine, the scanner(not shown) reads the original image, and the image data are subjected to a predetermined process to form toner images on the photosensitive drums 2Y, 2M, 2C and 2K corresponding to the colors Y, M, C and K, respectively. The transfer sheet 11 as a recording medium is fed onto the transferring belt 10 through the resist rollers 6 from the paper-feed unit 5, and is electrostatically adhered to the transferring belt 10, whereby the transfer sheet 11 is transported by the transferring belt 10. The respective color toner image formed on each photosensitive drum 2Y, 2M, 2C, 2K is transferred to the transfer sheet 11 one on another, and then the transferred images are fixed by the fixing rollers 7, whereby a full-color image is obtained.

Though this Tandem-type color copying machine has high-speed processing ability compared to another types of copying machines, it is expected that the Tandem-type color copying machine with higher-speed processing ability is developed.

The improved processing speed may be obtained by improving the copy processing speed, (e.g., transferring speed and the image processing speed), or by shortening the paper-feed interval.

However, in the former method which improves the copy processing speed, there will be a disadvantage that the load on electronically photographing becomes large. Therefore, relatively speaking, it is preferable to employ the latter method which shortens the paper-feed interval to improve the processing efficiency. However, it is difficult to shorten the paper-feed interval because of the reasons detailed below.

The transferring belt 10 of the Tandem-type copying machine is usually formed by overlapping and joining both longitudinal ends of a dielectric resin sheet made of, for example, polyethylene terephthalate resin or polyvinylidene fluoride resin to form an endless belt. Thus, the transferring belt 10 has a seam 10*a*.

The characteristic of the seam 10*a* is different from that of the other portion. Accordingly, if the transfer sheet 11 is fed onto the transferring belt 10 such that the transfer sheet 11 overlaps the seam, the image transferring sometimes cannot be preferably performed to cause an inappropriate image transfer, resulting in poor images on the transfer sheet 10.

Alternatively, an endless transferring belt may be formed by using molding dies. However, weld lines of the molding dies may appear on the belt. The characteristic of the weld lines is different from that of the remaining portion of the belt. The specific portion such as a seam or weld lines is hereinafter referred to as a seam.

Though it is possible to form an endless transferring belt with no seam, the cost for manufacturing the molding dies will be expensive. Further, in order to form a long endless transferring belt, large molding dies which are difficult to manufacture are required. Furthermore, such molding dies include a plurality of parts, which causes uneven thickness of the belt. Such uneven thickness affects the resist accuracy which is the most important factor in the full-color copying machine. Accordingly, under the present circumstances, an endless transferring belt is only used as a short length transferring belt in a small-size copying machine.

Under such circumstances, in a normal copying machine, it is controlled that the transfer sheet 11 is fed onto the transferring belt 10 so that the transfer sheet 11 does not overlap the seam of the transferring belt 10. Thus, in such a copying machine, the processing efficiency may dramatically fall depending on the size of the transfer sheet 11, which will be detailed with referring to the following conventional copying machine.

In this conventional copying machine, the process speed (i.e., traveling speed of the transferring belt) is set to be 120 m/s, and the length of the transferring belt is 780 mm, and the remaining factors are set as shown in Table 1. In Table 1, the required return time is the minimum required time for preparing the transferring of the images, and is determined by, for example, a time in which the scanner returns to the home position immediately after the scanner has completed to read the original. The minimum paper interval is the minimum interval of the transfer sheets, and is calculated by multiplying the required return time by the process speed (i.e., the traveling speed of the transferring belt). The designated paper interval is an actual paper interval, and is determined from the whole length of the belt and the number of the transfer sheets which can be placed on the whole length of the belt such that each of the transfer sheets does not overlap the seam taking the minimum paper interval into consideration.

In the copying machine, the following is a scenario if A4 size paper having a dimension of 297 mm×210 mm, which is the most popular paper in many offices, is fed such that the transverse direction of the paper coincides with the traveling direction of the transferring belt. If the A4 size papers 11 are consecutively fed onto the transferring belt 10 such that the leading edge of the initial paper 11 is located within the region of 50 mm or less from the seam 10*a* of the transferring belt 10 so as to avoid the seam, and then the subsequent papers 11 are fed at the interval of 50 mm (designated paper interval), the forth paper 11 is fed on the same position of the transferring belt 10 on which the initial paper 11 is fed. As a result, the papers are consecutively fed on the transferring belt avoiding the seam 10*a*. Accordingly, the images can be transferred to three pieces of papers 11 per one cycle of the transferring belt 10 with high image quality. In other words, the images can be transferred to twenty-eight pieces of papers 11 per minute with high efficiency.

On the other hand, in a case where A4 size paper 11 is fed such that the longitudinal direction of the paper 11 coincides with the traveling direction of the transferring belt 10, the papers 11 can be consecutively fed on the transferring belt 10 avoiding the seam 10*a*. Accordingly, the images can be transferred to two pieces of papers 11 per one cycle of the transferring belt 10 with high image quality. In other words, the images can be transferred to eighteen pieces of papers 11 per minute with relatively high efficiency.

However, in a case where A3 size papers 11 are fed such that the longitudinal direction of the paper 11 coincides with the traveling direction of the transferring belt 10, if the initial paper 11 is fed on the transferring belt 10 immediately after the seam 10*a* has passed, the second paper 11 overlaps the seam 10*a* of the transferring belt 10 even if the second paper 11 is fed at the minimum interval. This results in unfavorable image transferring. Accordingly, it is required to feed the second paper 11 at the interval of 360 mm after the seam 10*a* has passed. As a result, the image can be transferred to only one piece of paper 11 per one cycle of the transferring belt 10, in other words, the image can be transferred to nine pieces of papers 11 per minute with poor processing efficiency.

As is apparent from the above, in a case where A4 size paper is fed in the transverse direction thereof or in the longitudinal direction thereof, since the difference between the minimum paper interval and the designated paper interval is relatively small, the processing efficiency is high. However, in the case where A3 size paper is fed in the longitudinal direction thereof, since the difference between the minimum paper interval and the designated paper interval becomes large, the processing efficiency becomes low. In a case where A3 size paper is fed in the longitudinal direction, the processing efficiency is only one third the processing efficiency when A4 size paper is fed in the transverse direction thereof.

Further, in a case where A3 size paper is fed in the longitudinal direction thereof, not only the processing efficiency is low, but also the lifetime of the copying machine its self becomes short because of the following reasons. Though the minimum paper interval is 86 mm, the actual interval is required to be 360 mm, which means that the length of 274 mm of the transferring belt is not utilized. During the transferring belt of the 274 mm length is traveling, the photosensitive drums, the transferring belt, and other devices are kept rotating. The rotational time per paper becomes longer, which shortens the life of the copying machine.

Even if the whole length of the transferring belt is determined so that the processing efficiency can be improved in a case where A3 size paper is fed in the longitudinal direction thereof, the processing efficiency of another size paper becomes low. Thus, the processing efficiency cannot be essentially improved.

SUMMARY OF THE INVENTION

It is an object of the present invention to provide an image forming apparatus by which high quality image can be formed with high efficiency.

The inventors of the present invention have found the fact, as a result of continuous and diligent efforts, that some types of images may not be adversely affected by the seam of the transferring belt when the recording medium, such as a transfer sheet, is fed on the transferring belt for transferring the image so as to overlap the seam. For example, the inventor have revealed the fact that the image of the original with text, which is usually used in many offices, will not be adversely affected by the seam of the transferring belt. Based on the revealed fact, the inventors have repeatedly and continuously conducted their studies and experiments, and have found the most appropriate construction of the image forming apparatus which can attain the above-mentioned purposes.

According to the first aspect of the present invention, an image forming apparatus includes an endless transporting unit having a seam. The transporting unit transports a recording medium with holding the recording medium thereon. The apparatus further includes an image forming unit which forms an image on the recording medium held by the transporting unit, a feeder which feeds the recording medium to the transporting unit and a controller which selectively controls at least one of the transporting unit and the feeder in one of a first mode and a second mode based on a character of the image. The recording medium is fed to the transporting unit so as not to overlap the seam in the first mode, and the recording medium is fed to the transporting unit regardless of the seam in the second mode.

The image forming apparatus controls the transferring unit and the feeder based on the type of the image. Therefore, in a case where the image which is adversely affected by the seam is to be formed, the recording medium can be fed to the transporting unit so as to avoid the seam, and in the case where the image which is not affected by the seam is to be formed, the recording sheet can be fed regardless of the seam by shortening the paper interval. As a result, the paper interval as a whole can be short and the process efficiency can be improved.

The image forming apparatus according to the first aspect of the present invention may further include an image information acquiring unit for acquiring image information regarding a character of the image.

In the image forming apparatus according to the first aspect of the present invention, if the image information acquiring unit is composed of an information input unit for manually inputting information regarding the image, the controller may control at least one of the transporting unit and the feeder based on the information inputted through the information input unit.

Further, in the image forming apparatus according to the first aspect of the present invention, if the image information acquiring unit is composed of an image reader for reading the image, the image forming unit forms the image on the recording medium and the controller may control at least one of the transporting unit and the feeder based on the image information read by the image reader.

According to the second aspect of the present invention, an image forming apparatus includes a endless transporting belt which transports a recording medium, the transporting belt having a seam. The apparatus further includes a feeder which feeds the recording medium on the transporting endless belt, an image forming unit which forms an image on the recording medium fed by the feeder on the transporting endless belt, a seam-position detector which detects a position of the seam, an image information acquiring unit which acquires image information regarding whether or not the image includes a specific image which is adversely affected by the seam, and a controller which controls a timing at which the feeder feeds the recording medium based on information obtained by the seam-position detector and the image information acquiring unit. The controller selectively executes a first process in which the recording medium is fed at a predetermined timing regardless of the position of the seam in a case where the image does not include the specific image and a second process in which the recording medium is fed at a timing at which the image is not adversely affected by the seam in a case where the image includes the specific image.

The specific image which is adversely affected by the seam includes a color image, a photo image, a color photo image, and the similar, and the image which is not affected by the seam includes a white-and-black image, a text image, a map image, or the similar. However, the present invention is not limited to the above.

In the image forming apparatus according to the second aspect of the present invention, in a case where the specific image is to be formed, the recording sheet is fed to the transporting belt so as to avoid the seam, and in a case where the image which is not affected by the seam is to be formed, the recording sheet is fed to the transporting belt at a predetermined short paper-feed interval. Therefore, it becomes possible to shorten the paper-feed interval compared to the conventional apparatus in which the recording sheet is always fed so as to avoid the seam. Further, in the present invention, though the recording sheet may sometimes overlap the seam, since the specific image which is adversely affected by the seam is not formed to a region where the seam overlaps, the influence due to the seam can be effectively avoided, resulting in a good image quality.

In the image forming apparatus according to the second aspect of the present invention, in order to obtain image information with high reliability by utilizing a mode setting by a user or an automatic mode setting by ACS, the following may be employed.

In the image forming apparatus according to the second aspect of the present invention, the image information acquiring unit may be composed of an information input unit for manually inputting information regarding the image, and the image information regarding the specific image may be obtained through the information input unit.

Further, in the image forming apparatus according to the second aspect of the present invention, the image information acquiring unit may be composed of an image reader for reading an image of an original, and the image information regarding the specific image may be acquired through the image reader.

In the image forming apparatus according to the second aspect of the present invention, in order to improve the transporting efficiency and to assuredly avoid bad influences due to the seam, the following may be employed.

The image forming apparatus according to the second aspect of the present invention may further includes a predict unit which predicts whether or not the recording medium overlaps the seam when the recording medium is fed at the predetermined timing, wherein the controller controls in the second process such that the recording medium is fed at the predetermined timing when the predict unit predicts that the recording medium does not overlap the seam, and such that the recording medium is fed at a timing at which the recording medium does not overlap the seam when the predict unit predicts that the recording medium overlaps the seam.

Further, the image forming apparatus according to the second aspect of the present invention may further include a predict unit which predicts whether or not the recording medium overlaps the seam when the recording medium is fed at the predetermined timing; and a judge unit which judges whether or not the specific image is formed on an area of the recording medium where the seam overlaps when the predict unit predicts that the recording medium overlaps the seam, wherein the controller controls in the second process such that the recording medium is fed at the predetermined timing when the predict unit predicts that the recording medium does not overlap the seam, and such that the recording medium is fed at the predetermined timing when the predict unit predicts that the recording medium overlaps the seam and the judge unit judges that the specific image is not formed on the area, and such that the recording medium is fed at a timing at which the recording medium does not overlap the seam when the predict unit predicts that the recording sheet overlaps the seam and the judge unit judges that the specific image is formed on the area.

The image forming apparatus according to the third aspect of the present invention can be applied to an intermediate transferring type copying machine.

According to the third aspect of the present invention, an image forming apparatus includes a photosensitive drum on which a toner image is formed, an endless transferring belt having a seam, a feeder which feeds a recording medium to the endless transferring belt, wherein the toner image transferred from the photosensitive drum to the endless transferring belt is transferred to the recording medium fed by the feeder to the endless transferring belt, a seam-position detector which detects a position of the seam, an image information acquiring unit which acquires image information regarding whether or not the toner image includes a specific image which is adversely affected by the seam and a controller which controls the transferring belt based on information supplied by the seam-position detector and the image information acquiring unit. The controller selectively executes a first process in which the transferring belt is controlled regardless of the position of the seam in a case where the toner image does not include the specific image and a second process in which the transferring belt is controlled such that the image is not adversely affected by the seam in a case where the toner image includes the specific image.

The image forming apparatus according to the fourth aspect of the present invention can be applied to an apparatus having a transporting belt with a specific portion such as a weld line which is different in character from the other portion.

The image forming apparatus according to the fourth aspect of the present invention includes an endless transporting belt having a specific portion, a feeder which feeds a recording medium onto the endless transporting belt, an image forming unit which forms an image on the recording medium fed by the feeder to the endless transporting belt, a detector which detects a position of the specific portion, an image information acquiring unit which acquires image information regarding whether or not the image includes a specific image which is adversely affected by the specific portion, and a controller which controls a timing at which the feeder feeds the recording medium based on information supplied from the detector and the image information acquiring unit. The controller selectively executes a first process in which the recording medium is fed at a predetermined timing regardless of the specific portion in a case where the image does not include the specific image and a second process in which the recording medium is fed at a timing at which the image is not adversely affected by the specific portion in a case where the image includes the specific image.

Other objects and the features will be apparent from the following detailed description of the invention with reference to the attached drawings.

BRIEF DESCRIPTION OF THE DRAWINGS

The present invention will be more fully described and better understood from the following description, taken with the appended drawings, in which.

DETAILED DESCRIPTION OF THE PREFERRED EMBODIMENTS

Preferred embodiments of the present invention will now be described, in detail, with reference to the accompanying drawings.

<I. Overall Structure>

Figure 1:
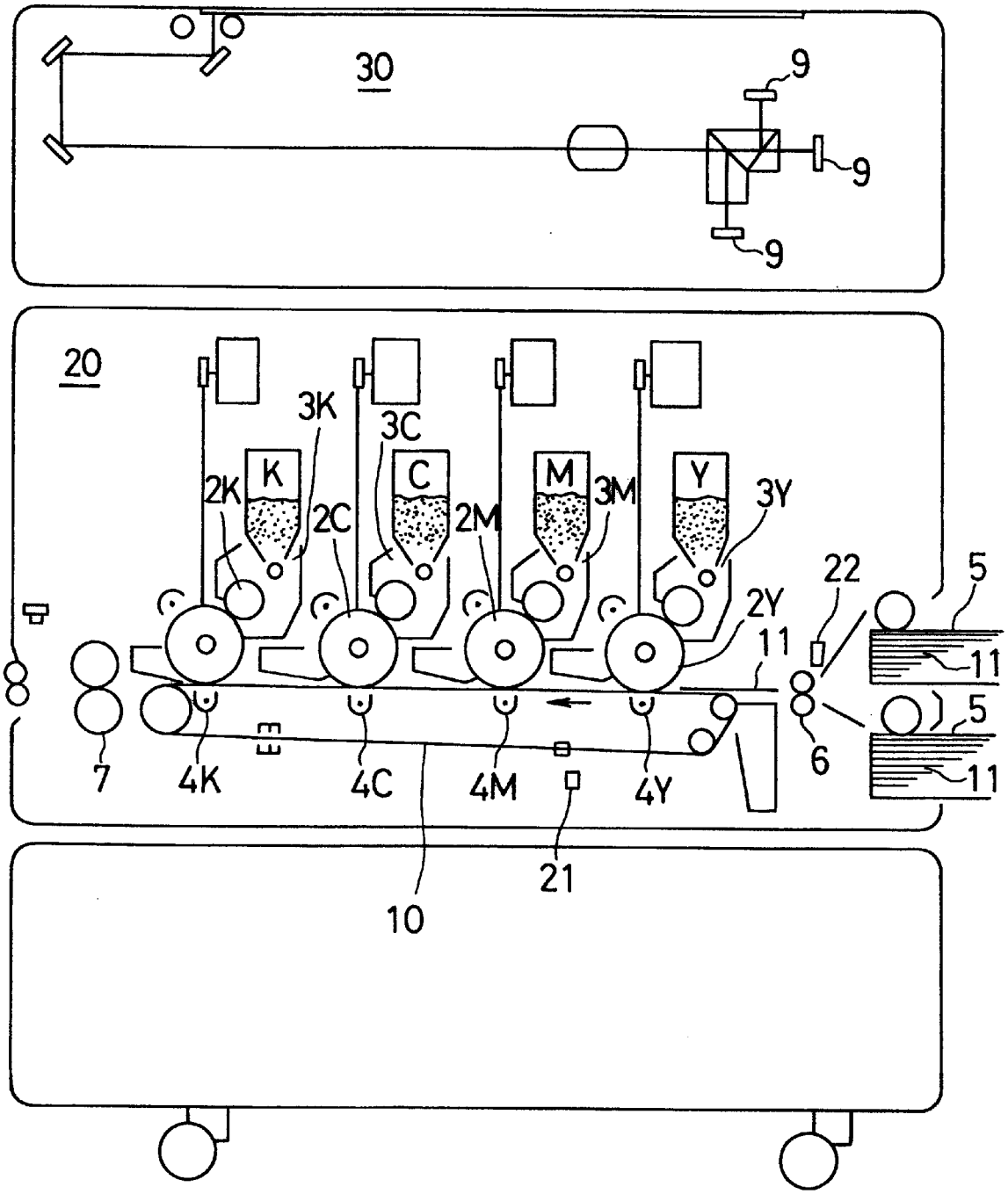
FIG. 1 is a schematic view of a Tandem-type digital color copying machine which relates to the present invention.

FIG. 1 is a cross-sectional side view of a tandem type full-color copying machine, to which the present invention is suitably applied.

As shown in FIG. 1, the scanner 30 reads information light obtained by color separation of the original image into three primary colors, red (R), green (G) and blue (B), via the CCD 9. The signal processor converts the information light into writing image data through computational process, based on the intensities of the respective information light. The writing image data are to be developed using yellow (Y), magenta (M), cyan (C), and black (K). The printer 20 optically writes the image onto the photosensitive drums 2Y, 2M, 2C, and 2K, which correspond to the colors Y, M, C and K, respectively, using laser beam modulated by the writing image data. Thus, electrostatic latent images are formed on the respective photosensitive drums. The electrostatic latent images are developed by the developers for the respective colors contained in the containers 3Y, 3M, 3C, and 3K, respectively, whereby the toner images of the respective colors are formed.

During this process, transfer sheets 11 (i.e., recording medium) are fed from the paper-feed port 5 via the resist rollers 6 to the transferring belt 10. The transfer sheet 11 is electrostatically adsorbed onto the transferring belt 10, and transported to the photosensitive drums 2. The toner images formed on the respective photosensitive drums 2Y, 2M, 2C, and 2K are successively transferred onto the transfer sheet 11 by the transfer chargers 4Y, 4M, 4C, and 4K, respectively, to reproduce the original image. The transferred image is fixed by the fixing rollers 7, whereby a full-color image is recorded on the transfer sheet 11. This transfer sheet 11 is ejected from the printer 20.

In FIG. 1, the numeral 21 denotes a seam detection sensor provided near the transferring belt 10 in order to detect the seam 10*a* of the transferring belt 10, and the numeral 22 denotes a sheet sensor 22 for detecting the leading edge of the transfer sheet 11.

<II. Signal Processor>

Figure 2:
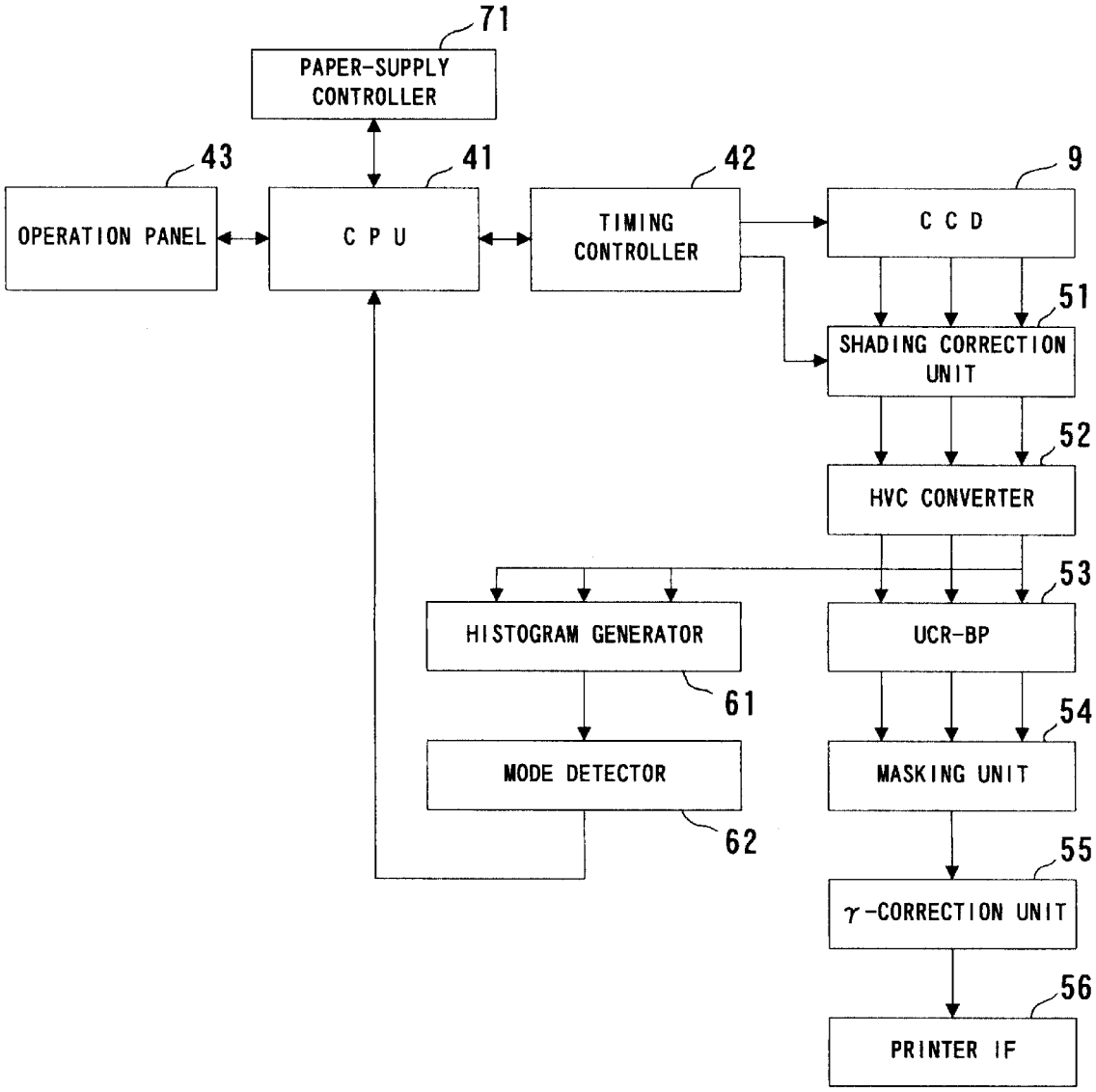
FIG. 2 is a block diagram showing a main portion of the signal processor of the copying machine.

FIG. 2 is a block diagram showing the major part of the copying machine shown in FIG. 1. The analog signals, which were obtained by photoelectrically converting the light components R, G, and B into electric signals, and represent the respective color information, are converted into digital forms. The digital data are supplied to the shading correction unit 51 which provides shading correction to the digital data in order to reduce the unevenness of the light quantity. The timing controller 42 controls the timing of the operations of CCD 9 and the shading correction unit 51.

Each of the R, G, and B data, which were subjected to the shading correction, is converted into a brightness signal and a color difference signal by the HVC converter 52. The R, G, and B data are also converted to the density data of Y, M and C. Then, the UCR-BP unit 53 removes the background noise, and provides inking. The masking unit 54 and the gamma correction unit 55 provide color correction, contrast adjustment, and brightness control. The printer interface 56 supplies this image data to the printer, which outputs an appropriately recorded image according to the mode of the original. Examples of the mode includes a black-and-white mode, a monotone mode, a color mode, a text mode, a picture mode, and a map mode.

The mode of the original may be manually selected by the user through manipulation of, for example, the operation panel 43, or alternatively, it may be automatically selected by the ACS (automatic color-mode selection).

In the automatic color-mode selection (ACS), the histogram generator 61 generates a histogram of brightness based on the brightness signal converted by the HVC converter 52. The type of the original is automatically determined based the histogram information.

Figure 3:
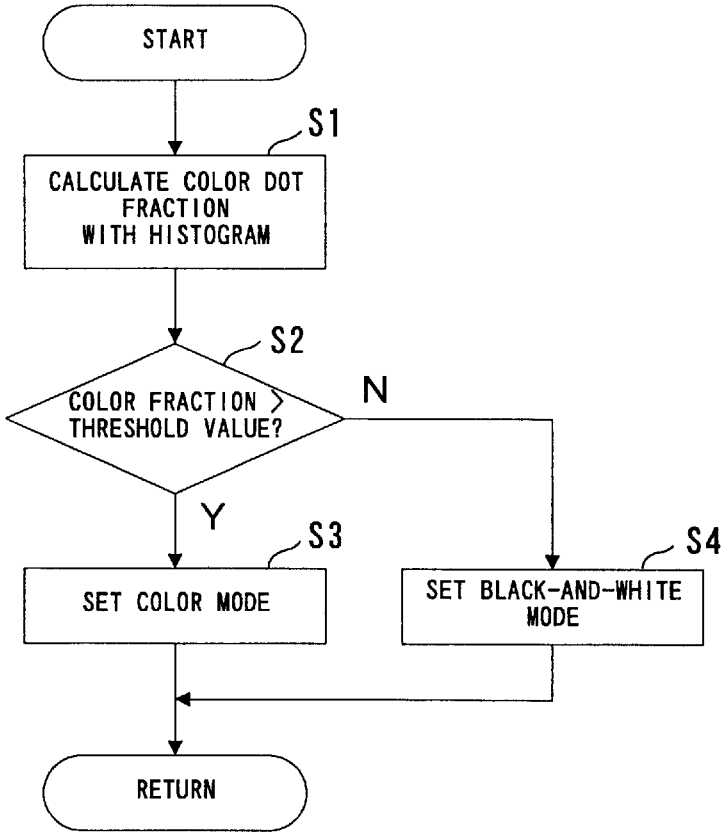
FIG. 3 is a flowchart showing an operational flow of the automatic color selection in the copying machine.

For example, in order to determine whether the original is color or black-and-white, the mode detector 62 executes operation flow shown in FIG. 3. First, in Step S1, the chromatic color dot ratio, which is the ratio of the number of dots in the color region to the total number of pixels in the original, is calculated based on the histogram. This ratio is compared with a predetermined threshold value in Step S2. If the color dot ratio is greater than the threshold value (YES in Step S2), it is determined that the original is a color image in Step S3. If the ratio is smaller than the threshold value (NO in Step S2), it is determined that the original is a black-and-white image in Step S4.

Figure 4:
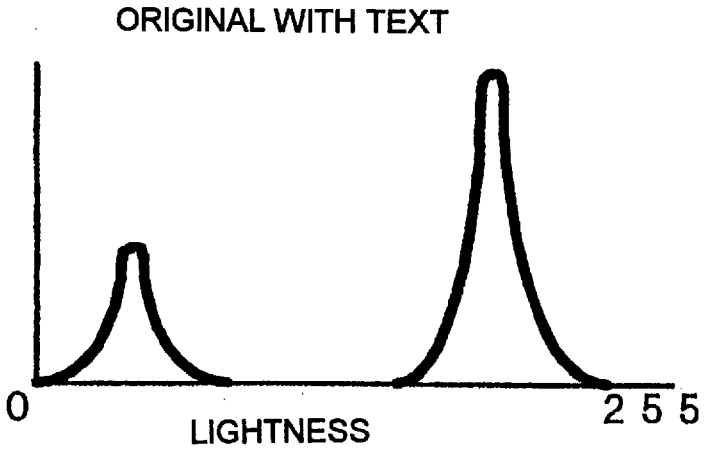
FIG. 4 is a graph showing a general brightness distribution of a text original.
Figure 5:
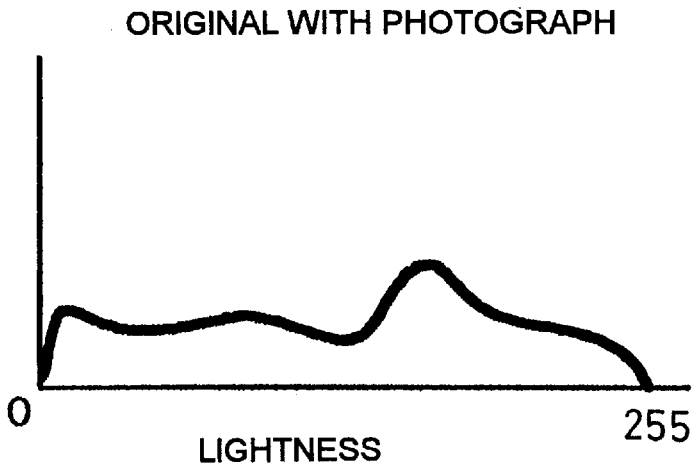
FIG. 5 is a graph showing a general brightness distribution of a photograph original.

Furthermore, a text image and a photo image can be distinguished based on the distribution of the histogram. While the histogram of a text image exhibits a double-peak (or binary) distribution as shown in FIG. 4, the histogram of a photo image exhibits a flat distribution over a wide range. Therefore, if the histogram exhibits a double-peak distribution, it is determined that the original is a text image, otherwise it is determined that the original is a photo image.

In this manner, the type of the original image is automatically judged, and the original mode is automatically selected based on the judged results.

Returning to FIG. 2, the paper-supply controller 71 acquires image information as to whether the original image contains certain types of images which are adversely affected by the seam of the transferring belt 10, based on the selected original mode. The paper-supply controller 71 then controls the driving system (e.g., the resist rollers 6 and other rollers) of the printer 20 based on the acquired image information and information supplied from the seam detection sensor 21 and the paper-supply sensor 22. Thus, the transfer sheet 11 is fed at a desired timing, the details of which will be described below.

The CPU 41 controls the entire operations of the signal processor. The operation panel 43 allows the user to input data, and displays the inputted data.

<III. Paper-supply Control by the Mode Selection by the User>

(III-1) Selection Between Color and Black-and-White Modes

Figure 6:
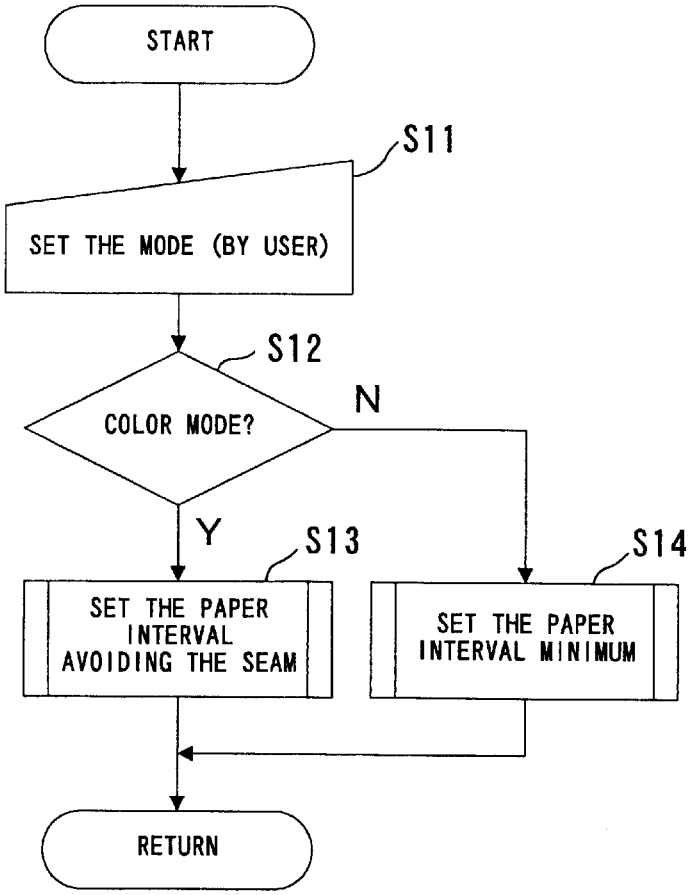
FIG. 6 is a flowchart showing an operation flow of the paper-feed control according to the first embodiment of the present invention.

The mode of the original image may be set by the user through manipulation of the operation panel, as shown in the flowchart shown in FIG. 6. In this case, the type of the original (i.e., the original mode) is first selected via the operation panel 43 in Step S11.

If the selected original mode is the color mode which is adversely affected by the seam 10*a* of the transferring belt 10 (YES in the determination of Step S12), the transfer sheet 11 is fed onto the transferring belt 10 at an ordinary paper-feed interval so that the transfer sheet 11 does not overlap the seam 10*a*.

Figure 7:
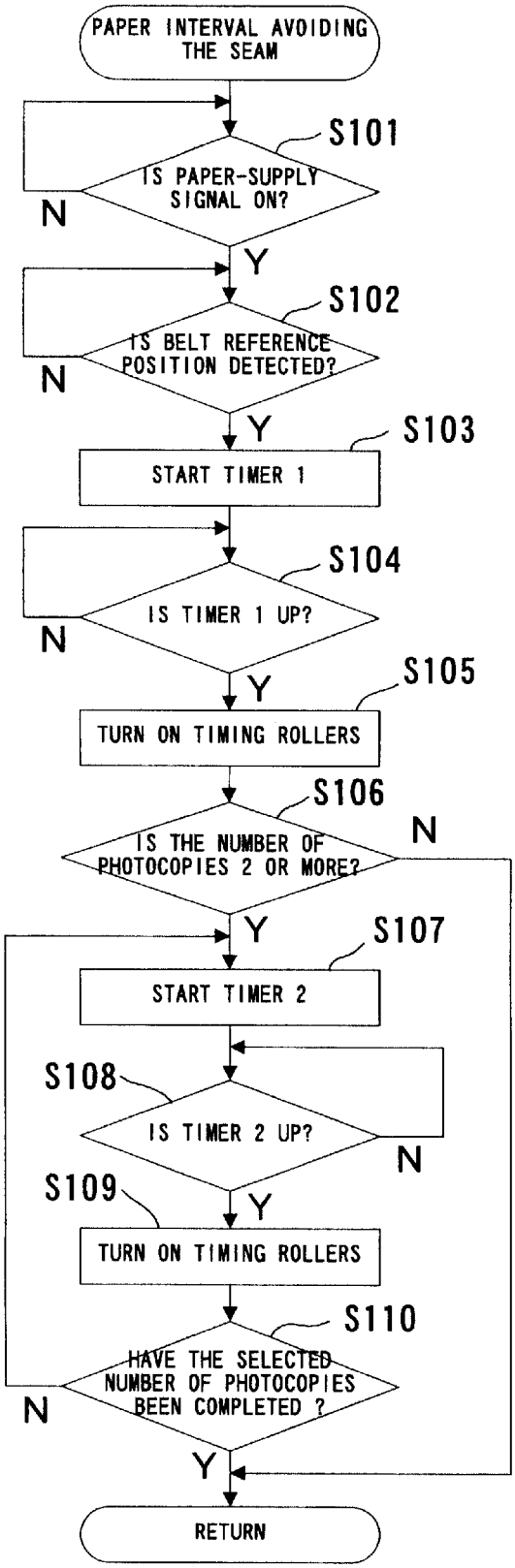
FIG. 7 is a flowchart showing an operation flow of the paper-feed control when the paper interval is set to be normal according to the first embodiment of the present invention.

FIG. 7 shows the operation flow of this paper-feed timing control. If it is confirmed that the transfer sheet 11 has been fed from the paper-feed port 5 to the resist rollers 6 in Step S101, it is determined in Step S102 whether the seam 10*a* of the transferring belt 10 has passed through the reference position. If a predetermined time has elapsed since the seam 10*a* passed through the reference point, (in other words, if the timer 1, which started counting in Step S103 when the seams 10*a* passed through the reference point, is up in Step S104), the transfer sheet 11 is fed onto the transferring belt 10 by the timing rollers (i.e., the resist rollers 6) in Step S105. To be more precise, the transfer sheet 11 is fed onto the transferring belt 10 so that the leading edge of the transfer sheet 11 is positioned immediately after the seam 10*a*. Thus, if the original includes a photograph image, the transfer sheet 11 is fed onto the transferring belt so that the sheet does not overlap the seam 10*a*.

Then, in Step S106, it is determined whether the number of photocopies for the original is two or more. If NO in Step S106, the photocopy operation terminates.

The predetermined time T1 set by the timer 1 in Step S103 is a constant value which is calculated so that the leading edge of the sheet 11 will be positioned immediately after the seam ila regardless of the size of the sheet. This constant value is calculated based on the traveling speed of the transferring belt 10 and the distance from the reference position, at which the seam detection sensor 21 is placed, to the paper-feed position, at which the resist rollers 6 are placed.

If the number of photocopies for the original is two or more (Y in Step S106), the next transfer sheet 11 is fed onto the transferring belt 10 in Step S109 after a predetermined time counted by the timer 2 in Steps S107 and S108 has elapsed. Then, if the selected number of photocopies has been completed in Step S110, the process returns.

The predetermined time T2 set by the timer 2 in Steps S107 and S108 corresponds to the predetermined paper-feed interval, which differs depending on the size of the paper. By feeding the second and subsequent sheets onto the transferring belt 10 at a paper interval corresponding to time T2, the sheet is correctly positioned on the transferring belt 10 so as not to overlap the seam 10*a*.

Thus, if the original image is color, the recorded image is likely to be adversely affected by the seam 10*a*, and therefore, the paper is fed so as to avoid the seam 10*a*, whereby a high image quality can be maintained.

Returning to FIG. 6, if the mode selected by the user is the black-and-white mode, which is not affected by the seam 10*a* very much, the transfer sheets 11 are fed onto the transferring belt 10 at the minimum paper intervals, as shown in S14, regardless of the position of the seam 10*a*.

Figure 8:
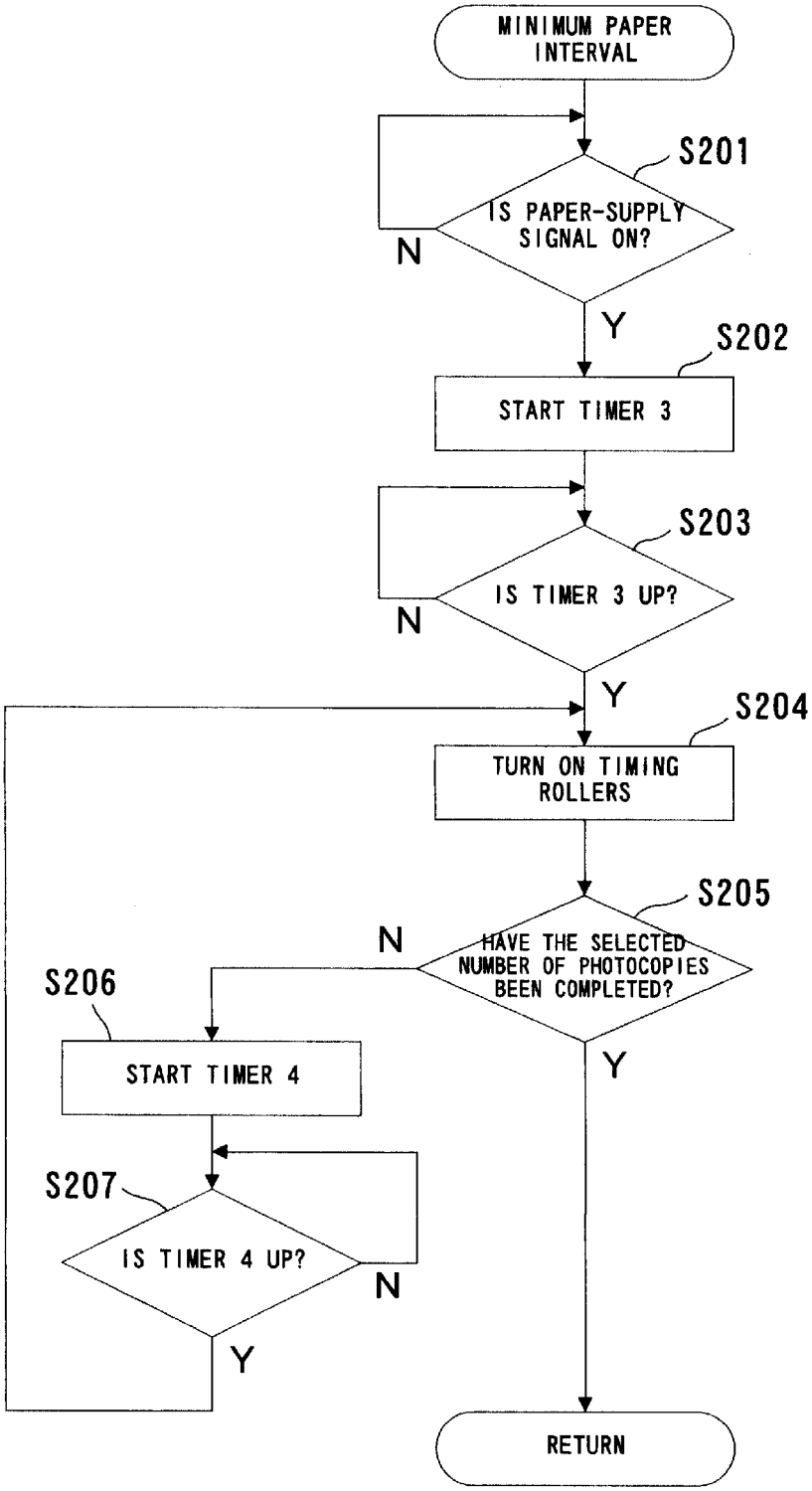
FIG. 8 is a flowchart showing an operation flow of the paper-feed control when the paper interval is set to be minimum according to the first embodiment of the present invention.

The paper-supply operation at the minimum interval is shown in FIG. 8. First, the transfer sheet 11 is fed from the paper-supply port 5 to the resist rollers 6 (Step S201). Then, after a predetermined time has been counted by timer 3 (Steps S202 and S203), the transfer sheet 11 is fed by the resist rollers 6 onto the transferring belt 10 (Step S204) regardless of the position of the seam 10*a*.

The time counted by the timer 3 in Steps S202 and S203 is required to be synchronized with the action of the transfer unit in the printer 20. This time interval is much shorter than the time required to wait the seam 10*a* passing by in Steps S102 through S104 in FIG. 7.

Next, if the selected number of photocopies has not been completed yet in Step S205, the remaining photocopying is successively performed. The transfer sheets 11 are successively fed onto the transferring belt 10 at a constant time interval, regardless of the position of the seam 10*a*. The time interval is counted by timer 4 in Steps S206 and S207. When all of the photocopies are completed, the process terminates.

The time counted by the timer 4 corresponds to the minimum paper interval.

In this manner, if the original is a black-and-white image, which is not adversely affected by the seam 10*a*, the transfer sheets 10 are successively fed at the minimum paper intervals, regardless of the position of the seam 10*a*. As a result, the photocopy operation can be performed with a high degree of efficiency.

In addition, because the paper-feed intervals are kept minimum, the rotation time of the photosensitive drum can be reduced, and the durability of the copying machine itself can be improved.

(III-2. Selection of Other Modes)

Instead of selecting the paper intervals based on the determination of the color image or the black-and-white image, the paper intervals may be changed based on the determination whether the original is a text or a picture.

For example, if the original mode input by the user through the operation panel 43 is the picture mode, the transfer sheet 11 is fed to the transferring belt 10 so as not to overlap the seam 10*a*, as in Step S13 (Steps S101 to S110) of FIG. 6. On the other hand, if the original is not a picture image (a text image), the transfer sheets are successively fed at the minimum paper intervals, regardless of the position of the seam 10*a*, as in S14 of FIG. 6.

As a modification, the paper supply operation can be controlled so that if the selected mode is the map mode, the paper intervals are narrowed if necessary. It can also be controlled so as to avoid the seam 10*a* only if the original is a color photograph. Thus, on what occasions the paper intervals are narrowed is arbitrary, and it is not limited to the zig embodiments described here.

In this embodiment, whether or not the image is adversely affected by the seam 10*a* is determined based on the original mode. In connection with this determination, any image information regarding whether the image is affected by the seam 10*a* may be input through the operation panel 43.

<IV. Paper-supply Control Based on ACS>

(IV-1.) Selection of Color Mode

Figure 9:
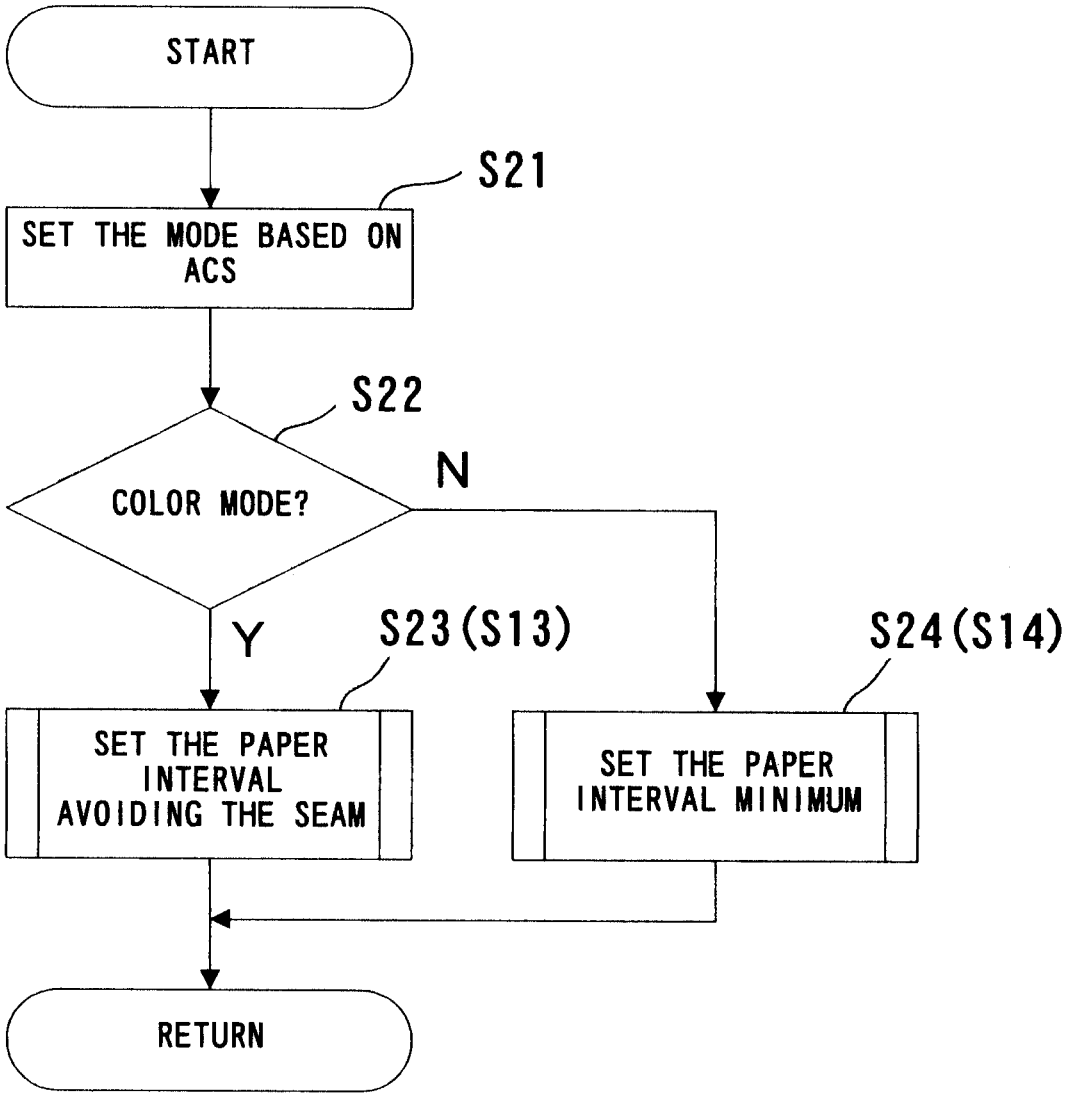
FIG. 9 is a flowchart showing an operation flow of the paper-feed control according to the second embodiment of the to present invention.

FIG. 9 shows the operation flow for the copying machine with an ACS function. With the ACS function, when the original is set on the scanner 30, whether the original is color or black-and-white is automatically detected, and the most appropriate mode is selected (Steps S21 and S22). If the selected mode is the color mode, the transfer sheet 11 is fed onto the transferring belt 10 at a paper-feed timing avoiding the seam 10*a* in Step S23. This paper-supply operation is the same as in Step S13 shown in FIG. 6.

If the black-and-white mode is detected by the ACS, the transfer sheets 11 are fed at the minimum intervals, regardless of the position of the seam 10*a*, in Step S24, similar to Step S14 shown in FIG. 6.

If an ADF (auto-document feeder) is provided to the scanner 30, and a plurality of originals are successively photocopied using the automatic feeding function, the determination of the color image or the black-and-white image may be made for each original. In this case, the paper intervals are adjusted for each transfer sheet based on the determination.

(IV-2.) Selection of Other modes

As has been described earlier, the copying machine with an ACS function can determine whether the original is a text or a picture, based on the histogram. If the original is a picture, the transfer sheets 11 are fed onto the transferring belt 10 so as to avoid the seam 10*a*. If the original is a text, the transfer sheets 11 are fed at the minimum intervals, regardless of the position of the seam 10*a*.

On what occasions the paper intervals are narrowed is arbitrary in this automatic selection mode, as in the manual selection described above, and it is not limited to the embodiments described here.

<V. Paper-supply Control Based on the Partial Areas on Original>

The ACS function can determine whether the original is color or black-and-white, or a text image or a picture. Therefore, it is also possible for the ACS to determine the layout of the original which includes both the area affected by the seam, which contains color images or pictures, and the non-affected area, which contains black-and-white images or texts. In fact, in many occasions, an original includes both color and black-and-white images (or text and picture images), just like calendars or catalogues. In addition, the paper size can be automatically selected based on the information from the paper-feed unit. Based on the paper size information and the mode information, the paper-feed timing can be controlled so that the area on the transfer sheet, in which an image affected by the seam is recorded, is not positioned on the seam 10*a*.

Figure 10:
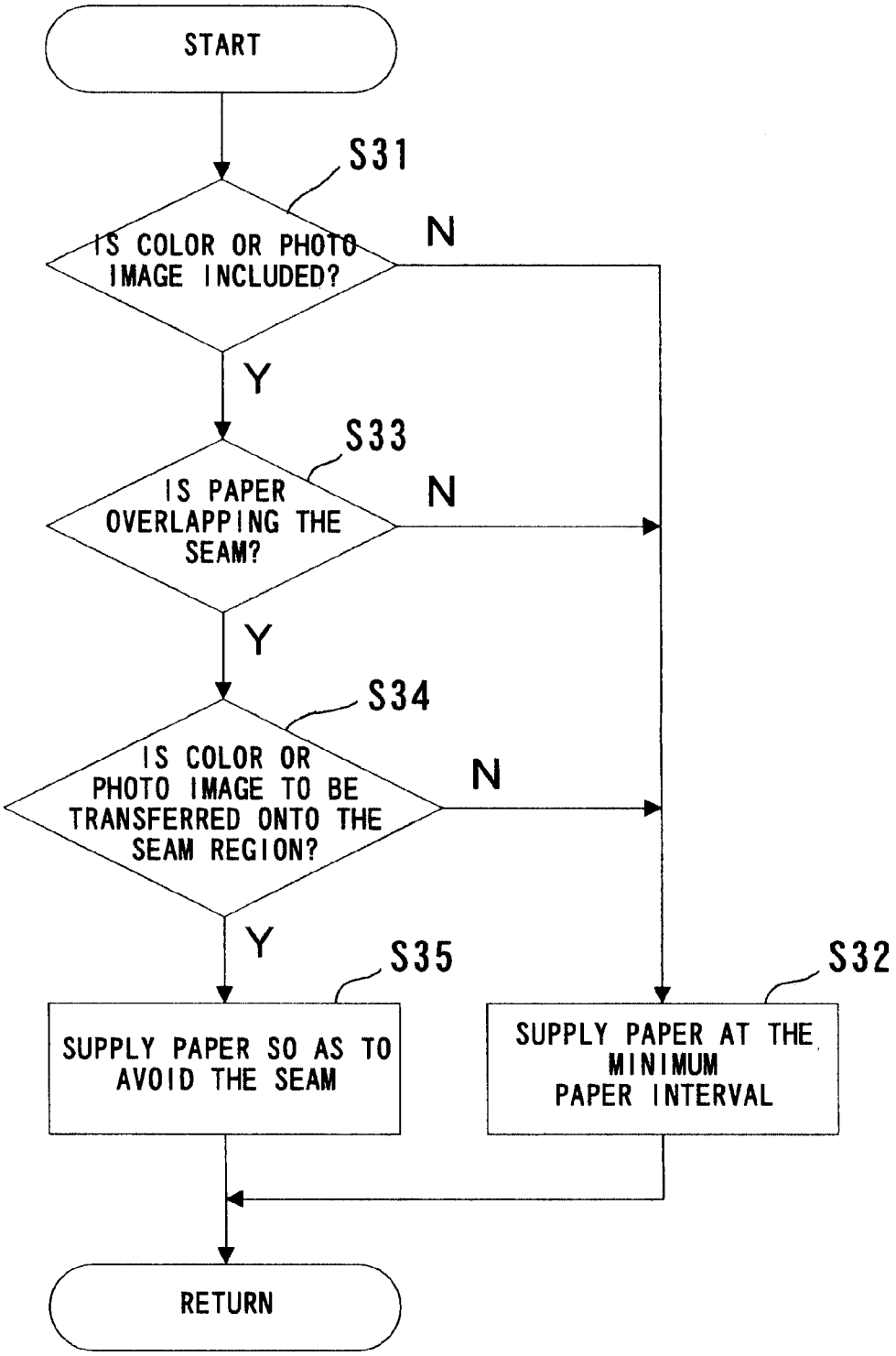
FIG. 10 is a flowchart showing an operation flow of the paper-feed control according to the third embodiment of the present invention.

This control operation is shown in the flowchart in FIG. 10. First, it is determined whether the original contains an image which is adversely affected by the seam 10*a* (Step S31). If the original does not contain such an image, the transfer sheets are fed at the minimum paper intervals, regardless of the position of the seam 10*a* (Step S32).

If the original contains an image affected by the seam, it is determined in Step S33 whether the transfer sheet 11 will overlap the seam 10*a* if the sheets are fed at the minimum intervals.

If it is predicted in S33 that the transfer sheet 11 will overlap the seam 10*a*, it is further determined in Step S34 if any images likely to be affected by the seam 10*a* are to be transferred onto the area on the sheet which will overlap the seam 10*a*. If NO in the determination of Step S34, the transfer sheets 11 are fed at the minimum paper intervals (Step S32).

If it is determined that any images which are likely to be affected by the seam 10*a* will be transferred onto the area on the sheet which is to be positioned on the seam 10*a*, the paper supply is suspended until the seam 10*a* has passed by. In other words, the transfer sheet 11 is fed onto the transferring belt 10 after the seam 10*a* has passed by (Step S35).

In this embodiment, the paper-feed interval is switched between the regular interval and the minimum interval. However, the paper-feed interval can be controlled more finely.

Figure 11:
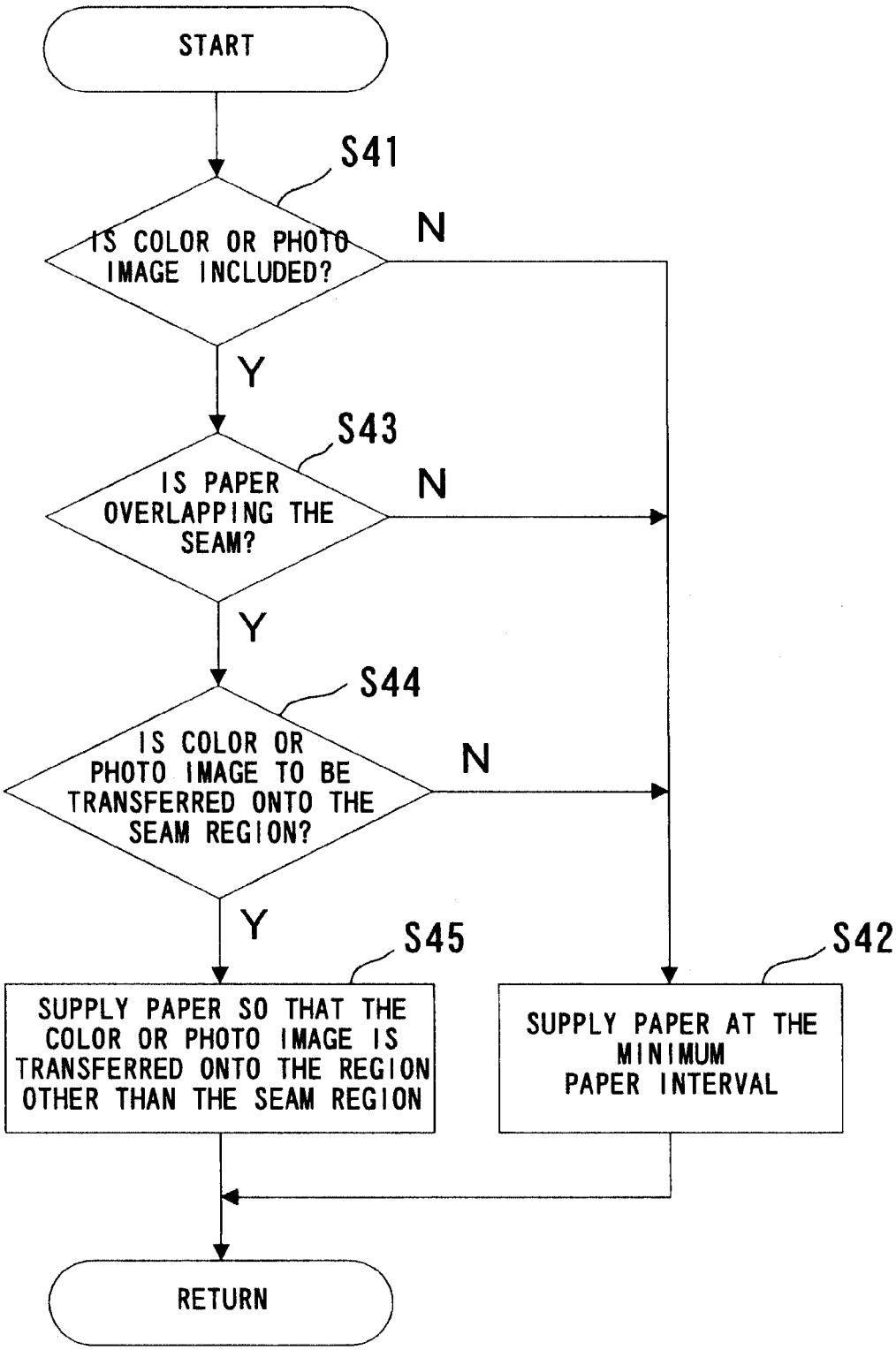
FIG. 11 is a flowchart showing an operation flow of the paper-feed control according to the fourth embodiment of the present invention.

FIG. 11 shows the operation flow of the more minute adjustment of the paper feed interval. Steps S41 through S44 are the same as Steps S31 through S34 shown in FIG. 10. If, in Step S44, it is determined that any images likely to be affected by the seam 10*a* will be recorded in the area on the sheet which is to overlap the seam 10*a*, the paper-feed timing is slightly delayed so that the images affected by the seam i0a will be recorded in the area on the sheet 11 which is not positioned on the seam 10*a*. In this example, it is not necessary for the transfer sheet 11 to be suspended until the seam 10*a* has completely passed by.

Table 1 shows some paper supply conditions. If an A3 original is photocopied with its longitudinal axis parallel to the paper feed direction under the conditions shown in Table 1, and if images (e.g., texts or black-and-white images) which are not affected by the seam 10*a* exist in the range of 274 mm from the leading edge of the original, then the paper feed interval between the first sheet 11 and the second sheet 11 can be shortened.

Although the invention has been described using the embodiment applied to a copying machine, the invention can also be applied to a laser printer, a facsimile machine, or other image forming apparatuses.

In the embodiments described above, "a predetermined timing" is the paper-feed timing at the minimum paper intervals. However, the predetermined timing can be set to any timing as long as it is shorter than the paper-feed timing for avoiding the seams 10*a* of the transferring belt 10.

Figure 12:
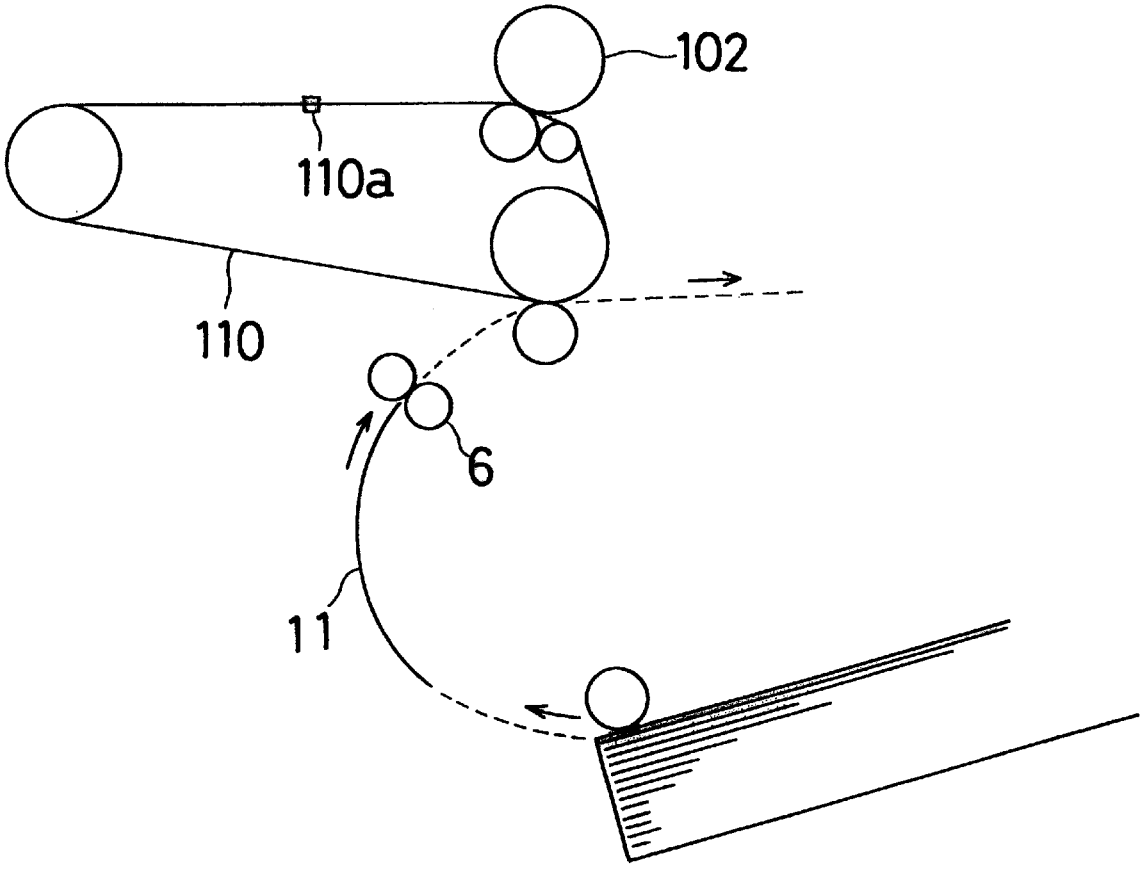
FIG. 12 is a schematic side view of a main portion of an intermediate transfer type copying machine according to an embodiment of the present invention.
Figure 13:
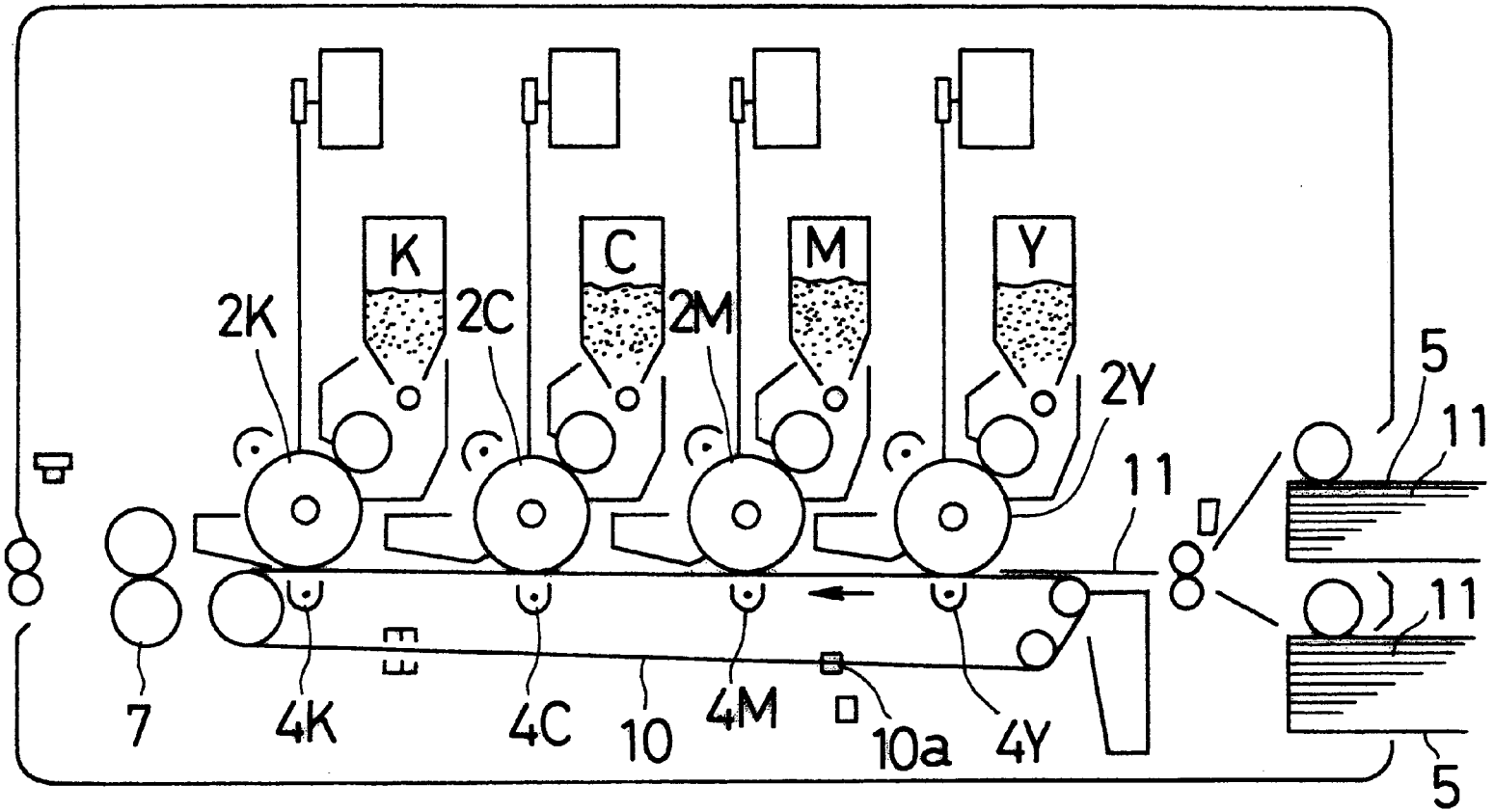
FIG. 13 is a schematic side view of a printer of a Tandem-type full-color copying machine.

The present invention can be applied to photocopiers of intermediate transfer types. FIG. 12 shows an example of the intermediate transfer type photocopier. The toner image formed on the photosensitive drum 102 is transferred onto the transfer sheet 11 via the intermediate transferring belt 110 which has a seam 110*a*. In this case, the intermediate transferring belt 110 is controlled so as to transfer the toner image onto the intermediate transferring belt 110 avoiding the seam 10*a*. The sheet 11 is fed to the intermediate transferring belt 110 at a timing at which the toner image is transferred onto the sheet 11.

In the embodiments, the longitudinal edges are connected to form a loop of the transferring belt, and the connected edge portion becomes the seam which may adversely affect the recorded image. The belt loop may be formed using a molding die. In this case, the weld line may affect the recorded image because the characteristic of the weld line differs from other area of the transferring belt. Therefore, the sheet is fed onto the transferring belt so as to avoid the weld line.

In the embodiments, the paper-feed timing is controlled by adjusting the recording medium feed means (i.e., the rollers). However, the present invention is not limited to these embodiments. For example, the paper transportation speed (e.g., the belt traveling speed) may be controlled so that the fed sheet does not overlap the seam.

Although the invention has been described using the seam of the image-transferring belt as a factor adversely affecting the image quality, the invention can also be applied to avoid adverse affect on the image quality due to other obstacles in the image-transferring belt, other than the seam.

This application claims priority to Japanese Patent Application No. H10(1998)-4424 filed on Jan. 13, 1998, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

TABLE 1

| Paper size | Length in the paper-feed direction | Required return time | Minimum paper interval | Designated paper interval | The number of paper per cycle | Yield |
|---|---|---|---|---|---|---|
| A 4 transverse direction | 210 mm | 0.4 second | 48 mm | 50 mm | 3 papers | 28 papers/minute |
| A 4 transverse direction | 297 mm | 0.4 second | 72 mm | 93 mm | 2 papers | 18 papers/minute |
| A 3 longitudinal direction | 420 mm | 0.8 second | 86 mm | 360 mm | 1 paper | 9 papers/minute |

Process speed 120 mm/s
Length of the belt 780 mm

What is claimed is:

1. An image forming apparatus, comprising:

a transporting unit which has an endless shape, said transporting unit having a seam, said transporting unit being for transporting a recording medium with holding the recording medium thereon, an image forming unit which forms an image on the recording medium held by said transporting unit;

a feeder which feeds the recording medium to said transporting unit; and a controller which selectively controls at least one of said transporting unit and said feeder in one of a first mode and a second mode based on a character of the image, wherein the recording medium is fed to said transporting unit so as not to overlap said seam in the first mode, and the recording medium is fed to said transporting unit regardless of said seam in the second mode.

2. The image forming apparatus as recited in claim 1, further comprising an image information acquiring unit for acquiring image information regarding a character of the image.

3. The image forming apparatus as recited in claim 2, wherein said image information acquiring unit is composed of an information input unit for manually inputting information regarding the image, and wherein said controller controls at least one of said transporting unit and said feeder based on the information inputted through said information input unit.

4. The image forming apparatus as recited in claim 2, wherein said image information acquiring unit is composed of an image reader for reading the image, wherein said image forming unit forms the image on the recording medium and said controller controls at least one of said transporting unit and said feeder based on the image information read by said image reader.

5. An image forming apparatus, comprising:

a transporting endless belt which transports a recording medium, said transporting member having a seam;

a feeder which feeds the recording medium on said transporting endless belt;

an image forming unit which forms an image on the recording medium fed by said feeder on said transporting endless belt;

a seam-position detector which detects a position of said seam;

an image information acquiring unit which acquires image information regarding whether or not the image includes a specific image which is adversely affected by said seam; and a controller which controls a timing at which said feeder feeds the recording medium based on information obtained by said seam-position detector and said image information acquiring unit, wherein said controller selectively executes a first process in which the recording medium is fed at a predetermined timing regardless of the position of said seam in a case where the image does not include the specific image and a second process in which the recording medium is fed at a timing at which the image is not adversely affected by said seam in a case where the image includes the specific image.

6. The image forming apparatus as recited in claim 5, wherein said image information acquiring unit is composed of an information input unit for manually inputting information regarding the image, wherein the image information regarding the specific image is obtained through said information input unit.

7. The image forming apparatus as recited in claim 5, wherein said image information acquiring unit is composed of an image reader for reading an image of an original, wherein the image information regarding the specific image is acquired through said image reader.

8. The image forming apparatus as recited in claim 7, further comprising a predict unit which predicts whether or not the recording medium overlaps said seam when the recording medium is fed at the predetermined timing, wherein said controller controls in the second process such that the recording medium is fed at the predetermined timing when said predict unit predicts that the recording medium does not overlap said seam, and such that the recording medium is fed at a timing at which the recording medium does not overlap said seam when said predict unit predicts that the recording medium overlaps said seam.

9. The image forming apparatus as recited in claim 7, further comprising a predict unit which predicts whether or not the recording medium overlaps said seam when the recording medium is fed at the predetermined timing; and a judge unit which judges whether or not the specific image is formed on an area of the recording medium where said seam overlaps when said predict unit predicts that the recording medium overlaps said seam, wherein said controller controls in the second process such that the recording medium is fed at the predetermined timing when said predict unit predicts that the recording medium does not overlap said seam, and such that the recording medium is fed at the predetermined timing when said predict unit predicts that the recording medium overlaps said seam and said judge unit judges that the specific image is not formed on the area, and such that the recording medium is fed at a timing at which the recording medium does not overlap said seam when said predict unit predicts that the recording sheet overlaps said seam and said judge unit judges that the specific image is formed on the area.

10. The image forming apparatus as recited in claim 7, further comprising a predict unit which predicts whether or not the recording medium overlaps said seam when the recording medium is fed at the predetermined timing; and a judge unit which judges whether or not the specific image is formed on an area of the recording medium where said seam overlaps when said predict unit predicts that the recording medium overlaps said seam, wherein said controller controls in the second process such that the recording medium is fed at the predetermined timing when said predict unit predicts that the recording medium does not overlap said seam, and such that the recording medium is fed at the predetermined timing when said predict unit predicts that the recording medium overlaps said seam and said judge unit judges that the specific image is not formed on the area, and such that the recording medium is fed at a timing at which the image is not formed on an area of the recording medium where said seam overlaps when said predict unit predicts that the recording sheet overlaps said seam and said judge unit judges that the specific image is formed on the area.

11. An image forming apparatus, comprising:

a photosensitive drum on which a toner image is formed;

an endless transferring belt having a seam;

a feeder which feeds a recording medium to said endless transferring belt, wherein the toner image transferred from said photosensitive drum to said endless transferring belt is transferred to the recording medium fed by said feeder to said endless transferring belt;

a seam-position detector which detects a position of said seam;

an image information acquiring unit which acquires image information regarding whether or not the toner image includes a specific image which is adversely affected by said seam; and a controller which controls said transferring belt based on information supplied by said seam-position detector and said image information acquiring unit, wherein said controller selectively executes a first process in which said transferring belt is controlled regardless of the position of said seam in a case where the toner image does not include the specific image and a second process in which said transferring belt is controlled such that the image is not adversely affected by said seam in a case where the toner image includes the specific image.

12. An image forming apparatus, comprising:

an endless transporting belt having a specific portion;

a feeder which feeds a recording medium onto said endless transporting belt;

an image forming unit which forms an image on the recording medium fed by said feeder to said endless transporting belt;

a detector which detects a position of said specific portion;

an image information acquiring unit which acquires image in formation regarding whether or not the image includes a specific image which is adversely affected by said specific portion; and a controller which controls a timing at which said feeder feeds the recording medium based on information supplied from said detector and said image information acquiring unit, wherein said controller selectively executes a first process in which the recording medium is fed at a predetermined timing regardless of said specific portion in a case where the image does not include the specific image and a second process in which the recording medium is fed at a timing at which the image is not adversely affected by said specific portion in a case where the image includes the specific image.

13. The image forming apparatus as recited in claim 12, wherein said endless transporting belt is an integrally formed article by forming dies, said formed article having no seam, and wherein said specific portion is a weld line of said endless transporting belt.

* * * * *